US006779321B1

(12) United States Patent
Kelemen

(10) Patent No.: US 6,779,321 B1
(45) Date of Patent: Aug. 24, 2004

(54) MACHINE AND METHOD FOR BAGGING ELONGATED PRODUCE

(75) Inventor: Louis E. Kelemen, Eustis, FL (US)

(73) Assignee: Zellwin Farms Company, Zellwood, FL (US)

( * ) Notice: Subject to any disclaimer, the term of this patent is extended or adjusted under 35 U.S.C. 154(b) by 180 days.

(21) Appl. No.: 09/590,494

(22) Filed: Jun. 9, 2000

(51) Int. Cl.[7] ..... B65B 5/06; B65B 9/10

(52) U.S. Cl. ..... 53/567; 53/168; 53/250; 53/386.1

(58) Field of Search ..... 53/502, 538, 567, 53/571, 168, 260, 250, 386.1

(56) References Cited

U.S. PATENT DOCUMENTS

| | | | | | |
|---|---|---|---|---|---|
| 3,688,471 | A | * | 9/1972 | Clark et al. | 53/571 |
| 3,842,569 | A | * | 10/1974 | McClelland et al. | 53/571 |
| 3,948,019 | A | * | 4/1976 | Doring et al. | 53/567 |
| 4,235,067 | A | | 11/1980 | Parsons | |
| 4,269,016 | A | | 5/1981 | Kopp et al. | |
| 4,495,751 | A | | 1/1985 | Galbiati | |
| 4,664,162 | A | | 5/1987 | Durant | |
| 4,674,268 | A | * | 6/1987 | Gavronsky et al. | 53/567 |
| 4,726,170 | A | * | 2/1988 | Sawa et al. | 53/386.1 |
| 5,024,042 | A | | 6/1991 | Meyer | |
| 5,174,094 | A | | 12/1992 | Powell, Jr. | |
| 5,259,172 | A | | 11/1993 | Peppard et al. | |
| 5,282,351 | A | * | 2/1994 | Tetenborg | 53/567 |
| 5,394,674 | A | | 3/1995 | Peppard et al. | |
| 5,448,879 | A | * | 9/1995 | Concetti | 53/567 |
| 5,452,559 | A | * | 9/1995 | Lipes | 53/570 |
| 5,542,238 | A | * | 8/1996 | Johnson et al. | 53/260 |
| 5,544,466 | A | | 8/1996 | Bonnet | |
| 5,595,468 | A | | 1/1997 | Wald | |
| 5,619,839 | A | | 4/1997 | Peppard et al. | |
| 5,775,066 | A | * | 7/1998 | Lamaire | 53/502 |
| 5,855,106 | A | * | 1/1999 | Koyama et al. | 53/168 |
| 6,016,643 | A | * | 1/2000 | Andersen | 53/502 |

* cited by examiner

*Primary Examiner*—John Sipos
(74) *Attorney, Agent, or Firm*—Allen, Dyer, Doppelt, Milbrath & Gilchrist, P.A.

(57) ABSTRACT

An apparatus and method for a produce bagging machine including a filling station positioned on a support frame, and including a filling chute movable to a first position for receiving produce from a produce supply and to a second position for delivering the produce into a bag. The filling chute may preferably be shaped as a box having a first opening positioned at an upper end for receiving produce, an interior cavity for therein holding the produce, and a second opening or door positioned at a lower end for therethrough delivering the produce. The filling chute door panels form angled walls at the lower end of the interior cavity so as to thereby guide individual pieces of elongated produce, preferably carrots, into substantially parallel alignment as the produce is delivered. Thus, the machine is useful for bagging elongated produce such as carrots in large, institutional sized bags of approximately fifty pounds capacity.

17 Claims, 11 Drawing Sheets

PRODUCE FROM WEIGHING DEVICE

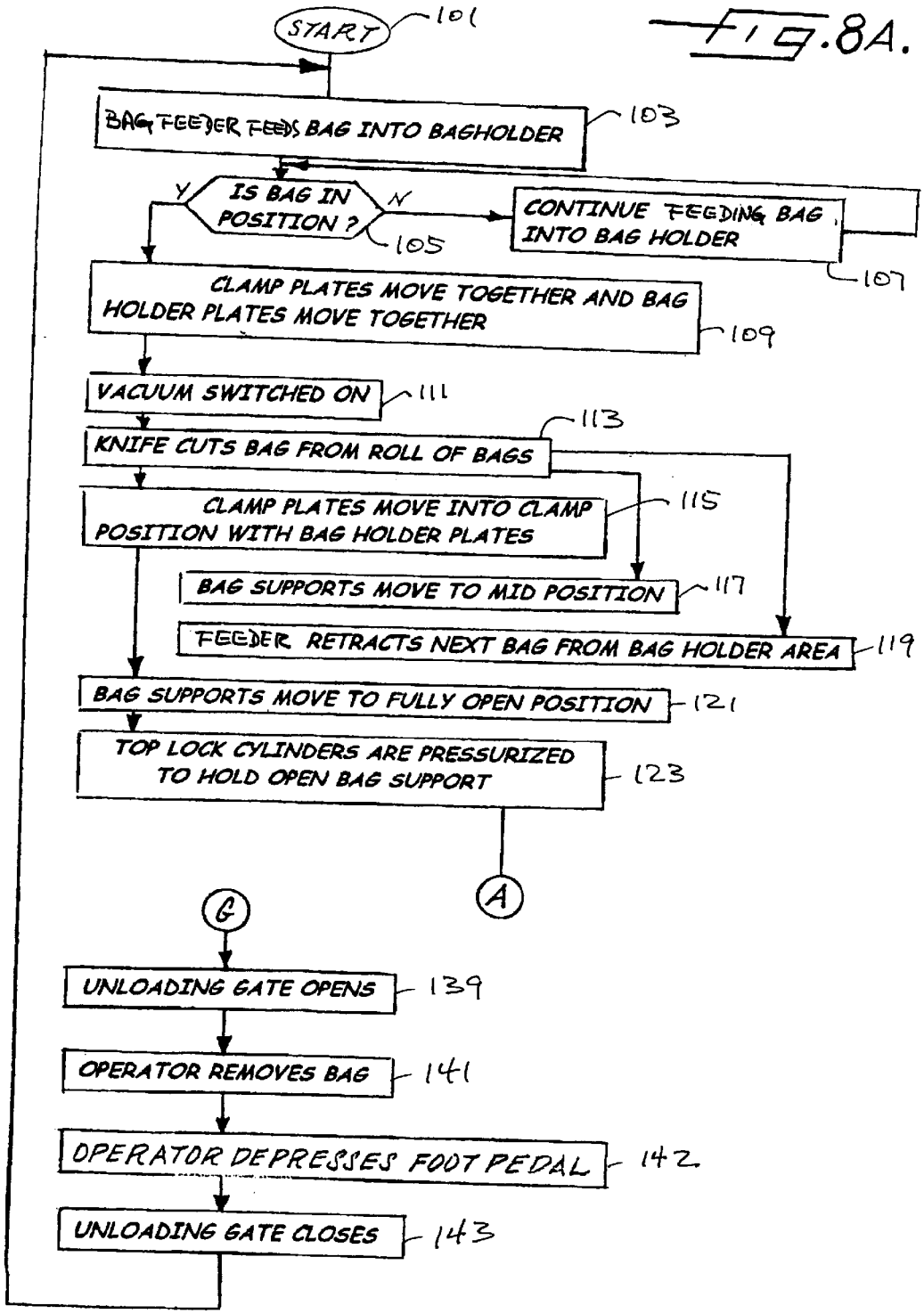
FIG. 8A.
START
101
BAG FEEDER FEEDS BAG INTO BAGHOLDER
103
IS BAG IN POSITION ?
Y
N
105
CONTINUE FEEDING BAG INTO BAG HOLDER
107
CLAMP PLATES MOVE TOGETHER AND BAG HOLDER PLATES MOVE TOGETHER
109
VACUUM SWITCHED ON
111
KNIFE CUTS BAG FROM ROLL OF BAGS
113
CLAMP PLATES MOVE INTO CLAMP POSITION WITH BAG HOLDER PLATES
115
BAG SUPPORTS MOVE TO MID POSITION
117
FEEDER RETRACTS NEXT BAG FROM BAG HOLDER AREA
119
BAG SUPPORTS MOVE TO FULLY OPEN POSITION
121
TOP LOCK CYLINDERS ARE PRESSURIZED TO HOLD OPEN BAG SUPPORT
123
A
G
UNLOADING GATE OPENS
139
OPERATOR REMOVES BAG
141
OPERATOR DEPRESSES FOOT PEDAL
142
UNLOADING GATE CLOSES
143

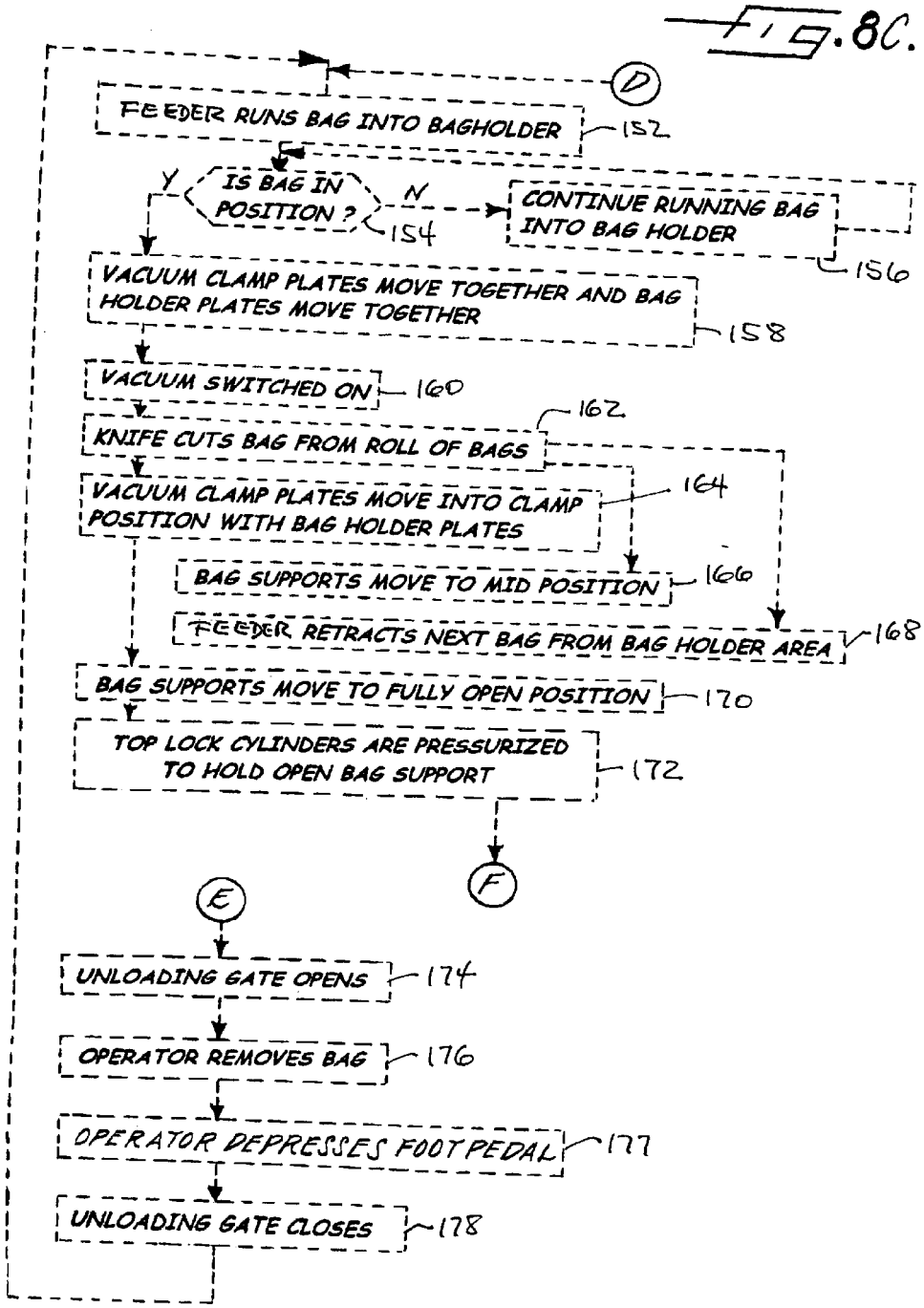
FIG. 8C.
D
FEEDER RUNS BAG INTO BAGHOLDER
152
IS BAG IN POSITION ?
154
Y
N
CONTINUE RUNNING BAG INTO BAG HOLDER
156
VACUUM CLAMP PLATES MOVE TOGETHER AND BAG HOLDER PLATES MOVE TOGETHER
158
VACUUM SWITCHED ON
160
KNIFE CUTS BAG FROM ROLL OF BAGS
162
VACUUM CLAMP PLATES MOVE INTO CLAMP POSITION WITH BAG HOLDER PLATES
164
BAG SUPPORTS MOVE TO MID POSITION
166
FEEDER RETRACTS NEXT BAG FROM BAG HOLDER AREA
168
BAG SUPPORTS MOVE TO FULLY OPEN POSITION
170
TOP LOCK CYLINDERS ARE PRESSURIZED TO HOLD OPEN BAG SUPPORT
172
F
E
UNLOADING GATE OPENS
174
OPERATOR REMOVES BAG
176
OPERATOR DEPRESSES FOOTPEDAL
177
UNLOADING GATE CLOSES
178

MACHINE AND METHOD FOR BAGGING ELONGATED PRODUCE

FIELD OF THE INVENTION

The present invention relates generally to the field of packaging agricultural products in bags and, more particularly, to packaging carrots and other elongated produce in large, institutional sized plastic bags.

BACKGROUND OF THE INVENTION

Machines for packaging agricultural products have been used in the art for quite some time. For example, known machines will use a sheet of synthetic plastic material to form a tube which is then cut and sealed to form a plastic bag for packaging the produce. These operations are usually performed in steps at stations connected by a conveyor belt. A pair of such packaging machines has been used in combination for providing increased production speed, as described in U.S. Pat. No. 4,269,016. Machines for feeding empty bags into a connected packaging machine have also been described in U.S. Pat. No. 5,595,468. However, the preparation of large, institutional sized bags of carrots and similar produce has been difficult to accomplish by machine and has traditionally required expensive, and time-consuming manual labor.

SUMMARY OF THE INVENTION

With the foregoing in mind, the present invention advantageously provides a produce bagging machine for filling large, institutional sized bags of carrots. The machine is additionally suitable for packaging other elongated agricultural products such as string beans.

The present bagging machine advantageously deposits the elongated produce into the bags in substantially parallel alignment. In addition, the machine fills the bags by successive deposits of predetermined amounts beginning with a deposit adjacent the bottom of the bag, each successive deposit being adjacent the previous one. In this manner, the machine advantageously reduces impact damage to the produce and fills bags with produce in substantially parallel alignment, making the packaged bags more attractive to the consumer, easier to handle, and easier to pack for shipment.

The produce bagging machine includes a support frame, positioned to support the machine on a surface. Two bag supplies are positioned on the support frame so that each supply comprises a roll of bag material providing a continuous stream of bags. Two bag holders are also positioned on the support frame to receive bags from the two bag supplies. Each bag holder opens each bag and holds the bag ready for filling with produce.

A filling station is positioned on the support frame and extends upwardly therefrom in the form of a tower. Produce is delivered through the filling station so as to fill a bag held in each of the bag holders. The filling station comprises a filling chute which moves to an upward position in the tower for receiving produce from a weighing machine working in combination with the bagging machine. When the filling chute has received produce it moves downwardly into the open bag so that the produce is deposited adjacent the bottom of the bag to substantially reduce impact damage to the produce. The filling chute cycles between the upward and downward positions to make successive deposits of produce into the bag, each successive downward movement controlled so as to deposit the produce adjacent the previous deposit. The filling chute thereby deposits the elongated produce into the bags in substantially parallel alignment, so that the elongated produce lies substantially horizontally along the bottom of the plastic bag and stacks upon itself in a neat and orderly fashion.

A main shuttle frame is positioned so as to move in a reciprocating manner on the support frame. The shuttle comprises two bag holders connected to substantially opposite ends of the shuttle frame, whereby the shuttle reciprocatingly positions each bag holder under the filling station for filling the bag with produce.

Additionally, the produce bagging machine preferably packages carrots, uses continuous plastic bag material, and includes a programmable logic controller ("PLC") operably connected to coordinate the functions of the machine. The machine is preferably used in combination with a produce weighing machine connected to the PLC and positioned to deliver a predetermined quantity of produce into the filling chute for deposit into the bags.

The machine provides automatic preparation and filling of the bags. While a first bag is being filled, a second bag is being positioned in the bag holder and opened in preparation for filling. Once the first bag is filled, the shuttle frame moves the filled bag to a bag loading station where an operator manually unloads the bag from the machine, subsequently a new bag being automatically loaded into the bag holder to await filling. While the first filled bag is being unloaded and replaced, the machine is filling a second bag. The produce bagging machine reduces the number of personnel required, while providing an increased production rate.

BRIEF DESCRIPTION OF THE DRAWINGS

Some of the features, advantages, and benefits of the present invention having been stated, others will become apparent as the description proceeds when taken in conjunction with the accompanying drawings in which:

FIGS. 4A–4D are views of the filling station of the machine of FIG. 1;

FIGS. 8A–8C are flow diagrams illustrating the method of the present produce bagging machine.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. FIGS. 1 through 7 illustrate the preferred embodiments of the invention.

Figure 1:
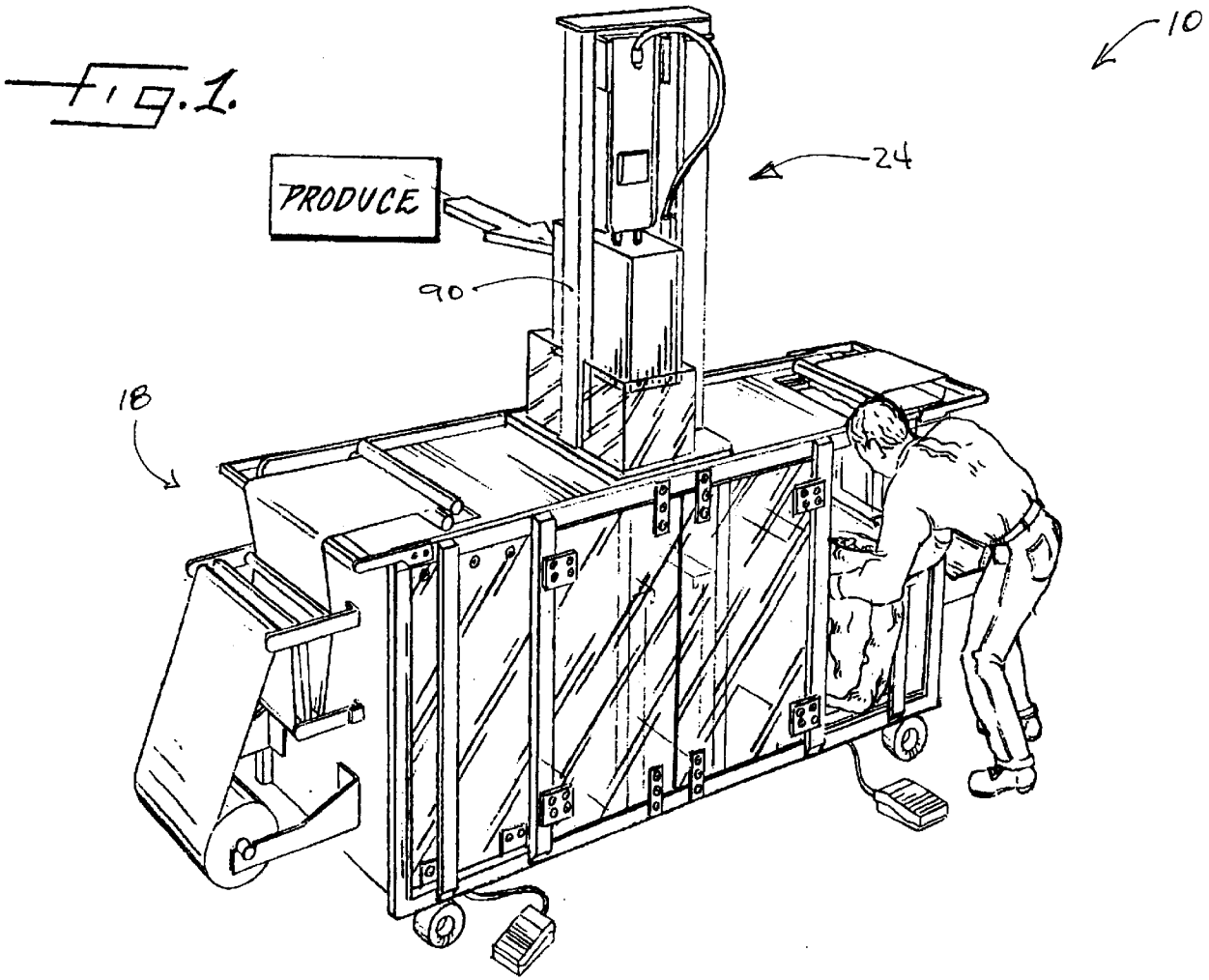
FIG. 1 is the produce bagging machine according to an embodiment of the present invention.

As shown in FIG. 1, the present invention describes a produce bagging machine 10 for use in a commercial produce packing operation. The machine 10 may be used for packaging produce in a variety of bag sizes, however, the machine is particularly useful for packaging large sized bags of elongated produce, preferably carrots. These large, institutional sized bags are preferably of a capacity of from about twenty five pounds (25 lbs.) to about fifty pounds (50 lbs.).

Figure 2:
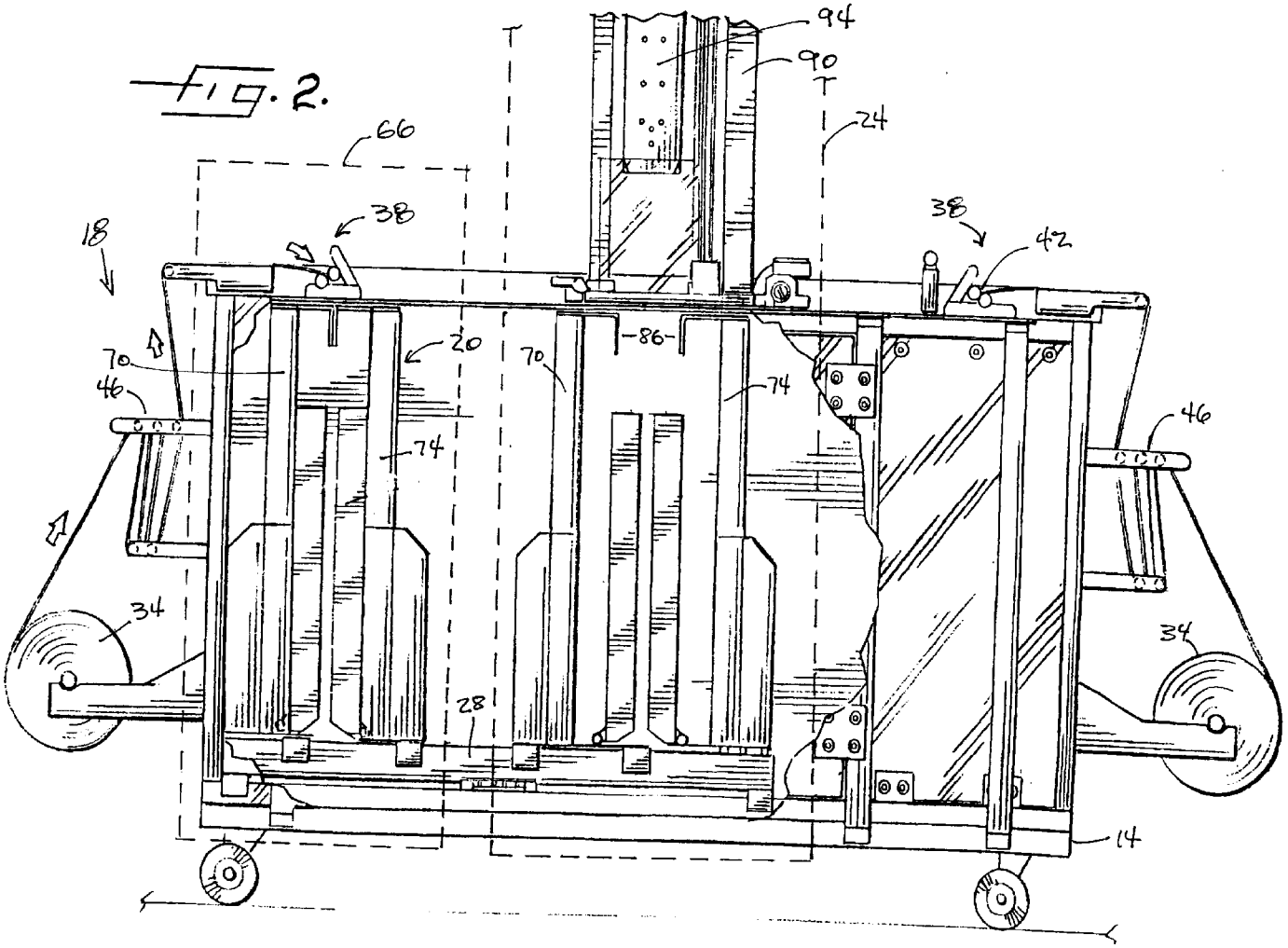
FIG. 2 is a schematic cutaway view of the machine shown in FIG. 1.

Referring now to FIG. 2, the machine 10 includes several component parts and assemblies shown in the various figures and which will now be described in detail, the major components of a preferred embodiment including a wheeled support frame 14 for housing the various components and for providing a movable platform, a bag supply 18 including a bag feeder 38, a bag holder 20, a filling station 24, a main shuttle frame 28, and a programmable logic controller 30 (PLC) connected to control and coordinate the functions of the machine. As those skilled in the art will appreciate, the various movements and operations of the machine are actuated through various known mechanisms, including electric motors, fluid compression devices such as pneumatic or hydraulic cylinders, mechanical drives, and other devices.

As shown in FIG. 2, the machine includes at least two bag supplies 18 positioned on the support frame 14 so that each bag supply holds a continuous supply of bags. Each bag supply 18 further includes a bag supply reel 34 positioned to hold a supply of bags in the form of a roll of continuous bag material. The continuous bag material is preferably a roll of plastic sleeve material wherein the individual bags are preformed and are separable from each other by cutting along lines of perforations which extend across the width of the sleeve material.

As shown in FIG. 3, each bag supply 18 includes a bag feeder 38 downstream from a bag supply reel 34. Each bag feeder 38 is positioned on the support frame 14 so as to feed bags from the bag supply reel 34 into a bag holder 20 in preparation for filling the bags with produce. The bag feeder 38 has at least one bag feed drive roller 42 positioned to feed the continuous stream of bag material from a bag supply reel 34 into the bag holder 20.

The bag feeder 38 additionally includes a bag feed tensioner 46, best shown in FIG. 2. The bag feed tensioner 46 is positioned on the support frame 14 in a direction of manufacture between the bag supply reel 34 and the bag feed drive roller 42, for maintaining a predetermined tension in the continuous stream of bag material to prevent the formation of slack in the continuous stream. Each bag feeder 38 preferably also includes a bag sensor 50, shown in FIG. 3, positioned on the support frame 14 to provide sensing information for positioning a bag 54 in an individual bag holder 20. The bag sensor 50 includes a spark generator 58 and a ground 62 positioned adjacent to the continuous sleeve of bag material 36 moving in a direction of manufacture. The spark generator 58 produces a spark which crosses through the line of perforations to the ground 62, which functions as a spark detector. The ground 62 is located on the opposite side of the continuous material from spark generator 58 for detecting the spark, to thereby sense when perforations of an individual bag have moved past the sensor 50. Upon sensing a bag, the sensor signals the PLC.

As shown in FIG. 2, plurality of bag holders 20 is positioned on the support frame to receive bags from a bag supplier 18. Each bag holder 20 properly positions a bag for filling with produce. The bag holder 20 is connected to a main shuttle frame 28 movably positioned on the support frame. The shuttle 28 serves for movably positioning each bag holder 20 such that a bag 54 positioned in the bag holder 20 is substantially aligned with a filling station 24 for filling with produce. The shuttle 28 preferably moves in a reciprocating manner, as illustrated schematically in FIG. 6. The machine 10 preferably includes two bag holders 20 connected to substantially opposite ends of the shuttle 28. A filling station 24 is positioned about midway between the opposite ends of the support frame 14, so that the shuttle 28 being reciprocatingly movable alternatively positions each of the two bag holders 20 substantially aligned with the filling station 24 for filling with produce. Thus, the shuttle 28 moves the bag holders 20 between the filling station 24 and a bag loading station 66, where bags from the bag supplier 18 are loaded into the bag holder 20, thereby positioning a bag for subsequently filling with the produce.

Figure 3A:
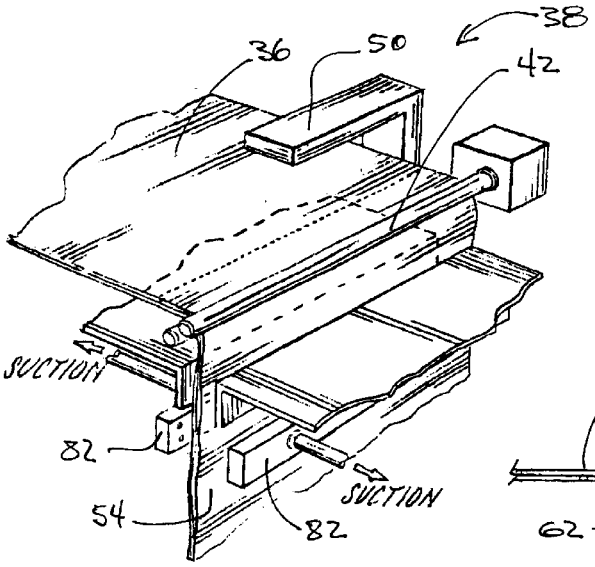
FIGS. 3A–3D are isolated views of the bag feeder in the machine of FIG. 1.
Figure 3B:
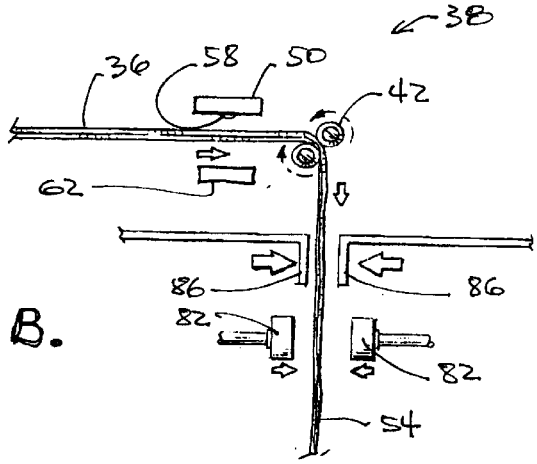
Figure 3C:
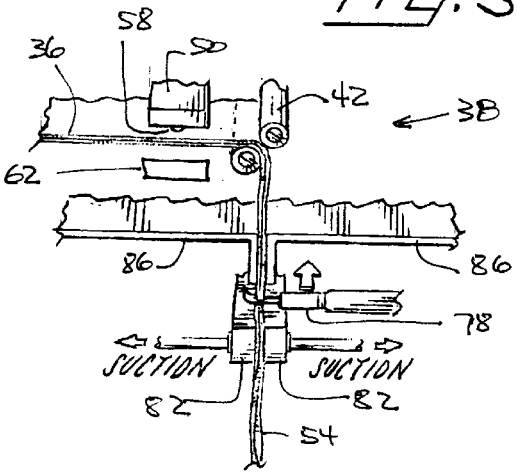
Figure 3D:
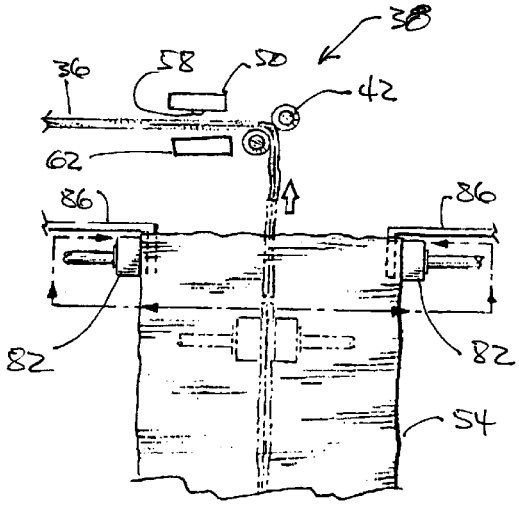
Figure 6A:
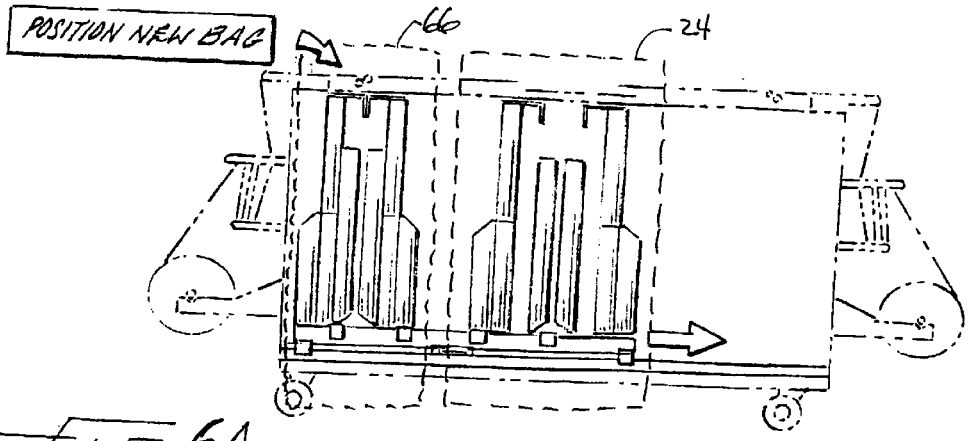
FIGS. 6A–6C are schematic views of the main shuttle frame in the machine of FIG. 1.
Figure 6B:
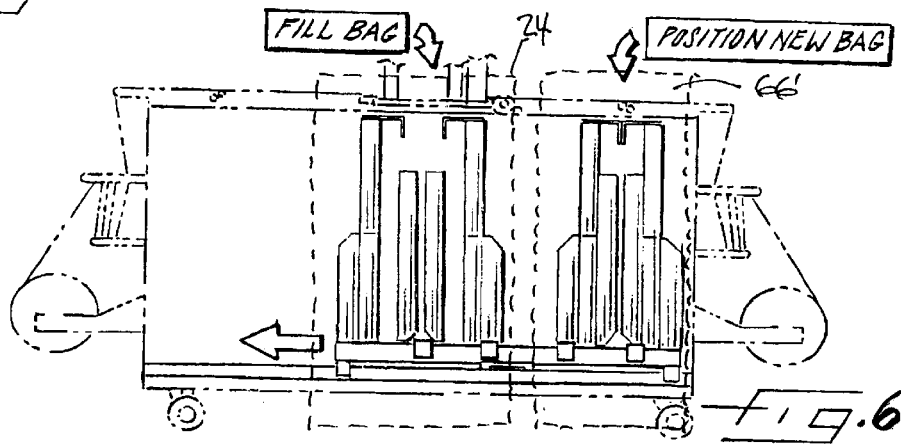
Figure 6C:
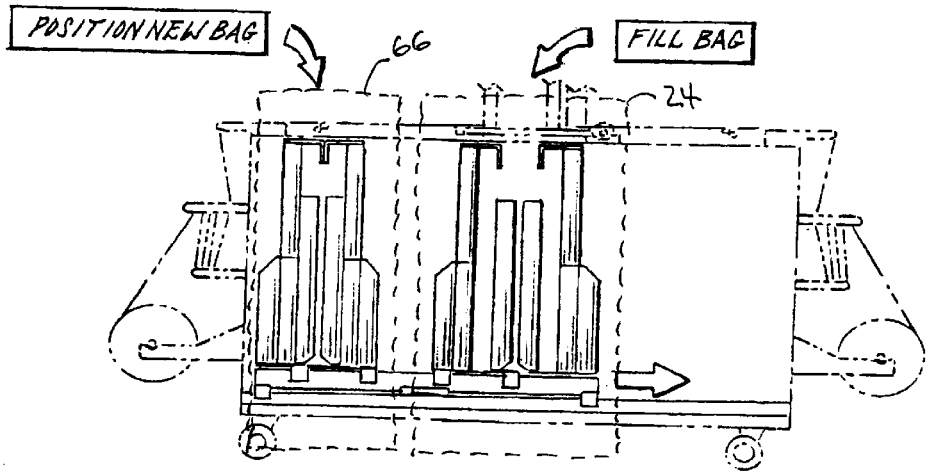
Figure 7:
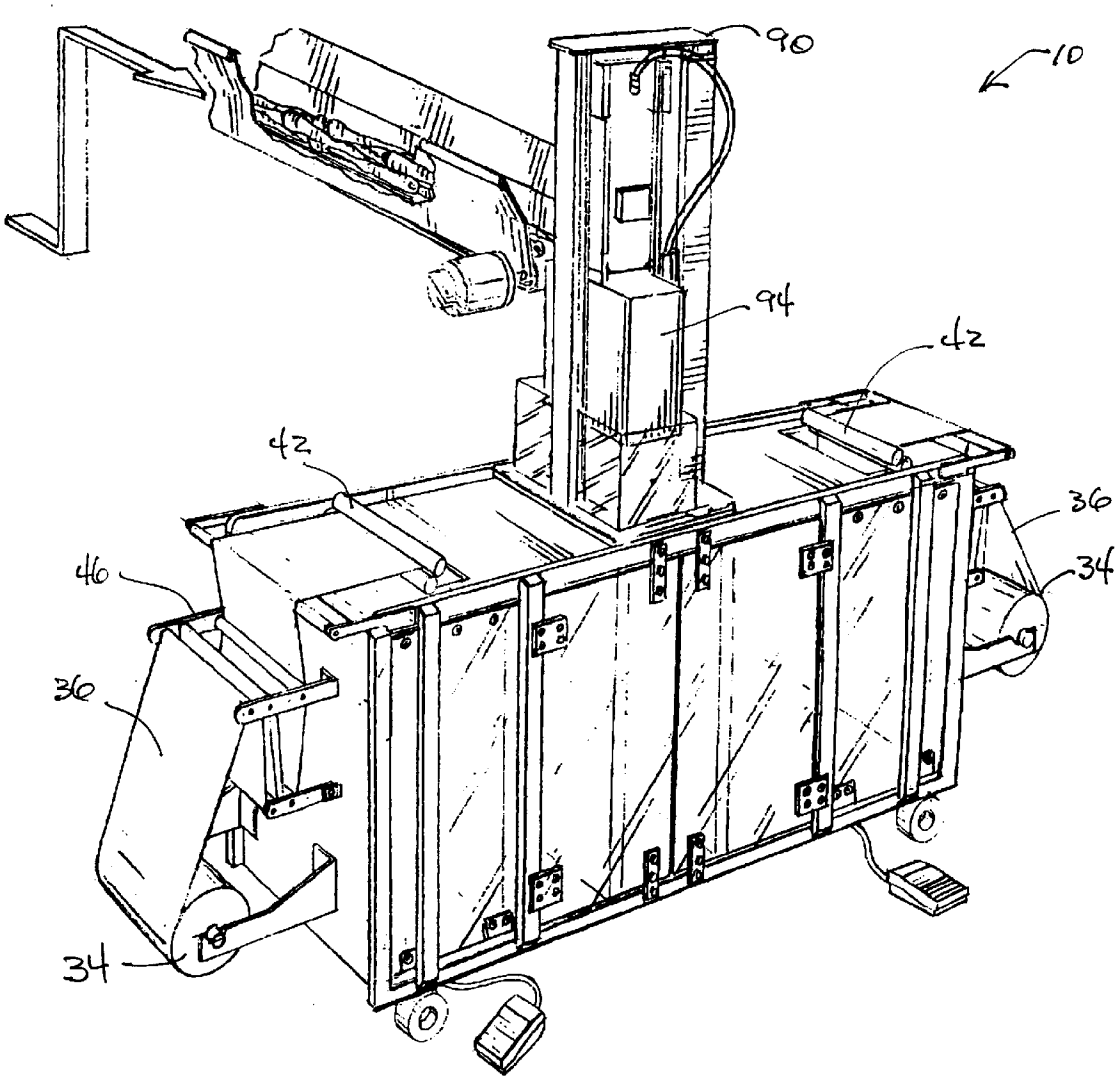
FIG. 7 is a top front perspective view of the machine of FIG. 1.

As shown in FIGS. 2 and 6, each bag holder 20 has a first side member 70 connected to the shuttle assembly so as to define a first periphery of the bag holder. A second side member 74 is movably connected to the shuttle assembly and positioned spaced-apart and substantially opposite the fixed side member 70 so as to therebetween define a void space of sufficient size for receiving a bag having a capacity for about fifty pounds of produce. A knife 78 is connected to the second side member 74 for separating an individual bag 54 from the continuous stream for positioning within the bag holder 20. The knife 78 may be any cutting means known in the art and suitable for this use, including an electrically heated edge. Preferably, one suction plate 82 is connected to each of the first 70 and second 74 side members for contacting upper peripheries of a bag 54 positioned within the bag holder 20, and to thereby apply suction to these upper peripheries as seen in FIG. 3. The second side member 74 subsequently moves away from the first side member 70 while both suction plates 82 apply suction to the upper peripheries of the bag to thereby pull the peripheries apart, opening the bag. Preferably, each of the first 70 and second 74 side members include a clamping plate 86 so as to clamp the upper peripheries of the open bag between the clamping plate 86 and the movable suction plates 82, thereby securing the bag 54 in an open position ready for filing with produce as seen in FIG. 3*c*. At least two bag guides 87 are movably connected to the shuttle assembly relative to the first 70 and second 74 side members so as to adjacently align with exterior sides of the bag 54 when opened, and thereby serve to guide produce for filling the bag evenly.

Figures 4A, 4B:
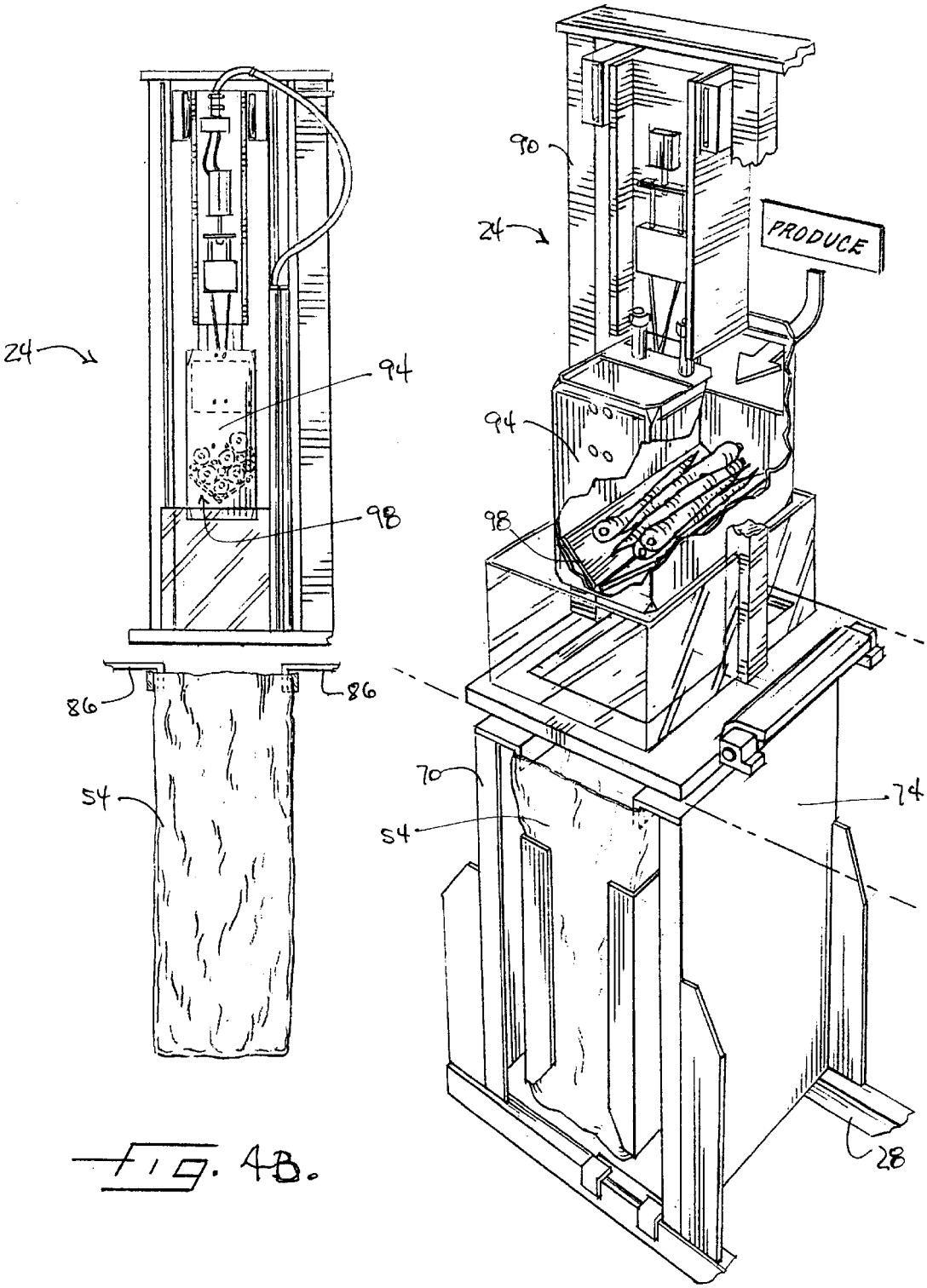

The filling station 24, shown in FIG. 4, is positioned on the support frame 14 to deliver produce so as to fill a bag held in an individual bag holder 20. The filling station 24 is preferably positioned above the support frame 14 and extends vertically upwardly therefrom, as best shown in FIGS. 1, 2 and 4, forming a filling station mast 90. The mast 90 is substantially a tower having an interior hollow shaft for housing a movable filling chute 94. The chute 94 is connected to a filling chute frame 93 movable upwardly to an upper end of the mast 90 for receiving produce and movable a predetermined distance downwardly into the bag holder 20 alignedly positioned in the filling station 24 to deliver the produce into the bag 54. As seen in FIG. 4, the chute has the general shape of an elongated box having a hollow interior for therein holding produce. A lower side of the chute 94 includes a door 98 for therethrough controllably delivering the produce. The filling chute door 98 preferably comprises two panels positioned relative to each other so as to form a wedge shaped extension on a lower surface of the chute 94, as best shown in FIG. 4A. The wedge shaped extension operates by having the two panels open to therethrough release the produce into a bag. The wedge-shaped design of the filling chute door 98 guides the elongated produce to align in substantially parallel orientation. When the elongated produce is deposited from the chute 94 into the bag, the produce is aligned along the width of the bag, resulting in an orderly arrangement which makes the filled bags easier to handle and easier to package for shipment.

Figure 4C:
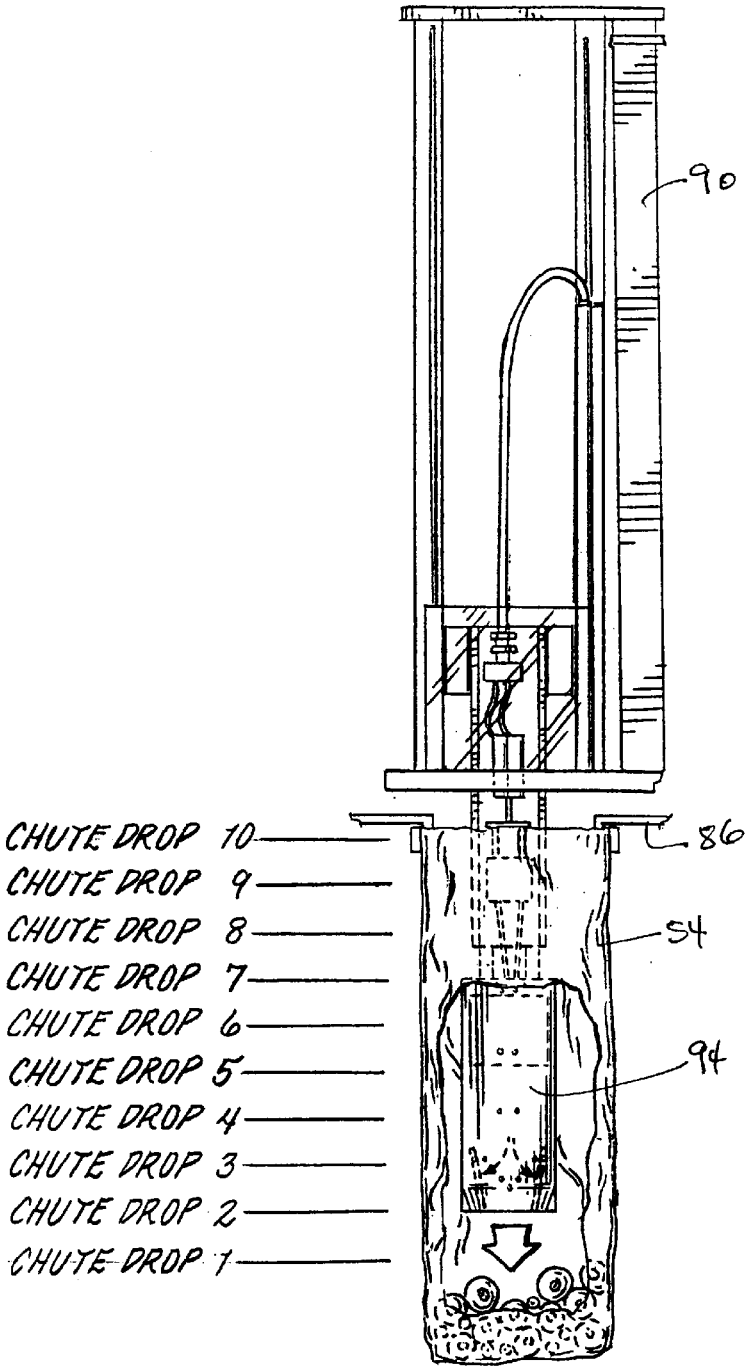
Figure 5:
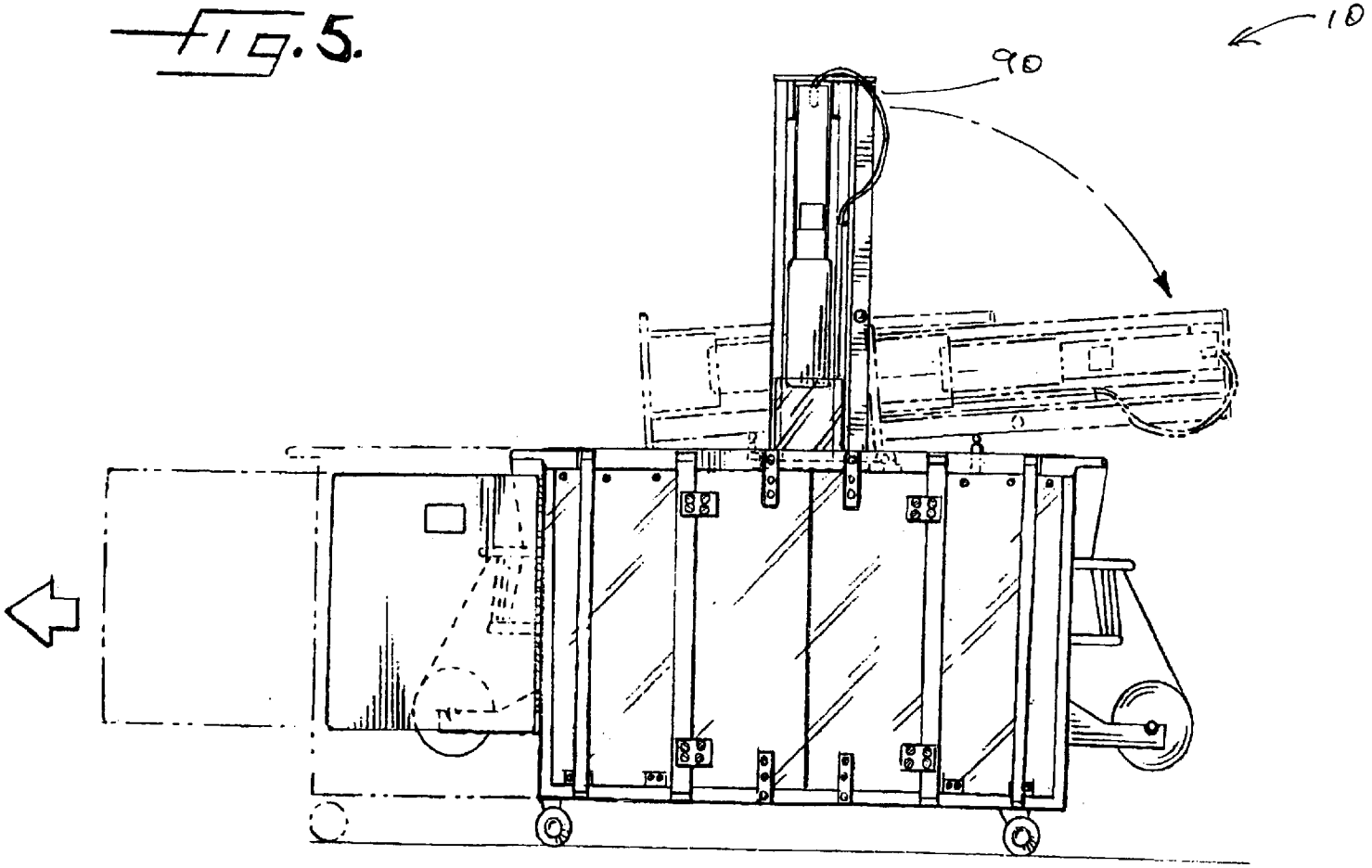
FIGS. 5 is a front elevation of the machine of FIG. 1 being readied for moving.

In addition, as illustrated in FIG. 4*c*, the filling chute 94, is controlled to make several successive deposits, or drops, in filling each bag. Each successive drop is controlled to deposit the produce adjacent the previous deposit to thereby reduce impact damage to the produce and to advantageously promote the substantially parallel alignment of the produce.

In operation, the machine of the present invention is preferably used in combination with a produce weighing machine or device. The weighing machine is preferably also connected to the PLC for operating controllably in tandem with the bagging machine. The weighing machine is adjacently positioned to deliver a pre-weighed quantity of produce into the filling chute 94 when the chute is at its uppermost position.

Figure 8B:
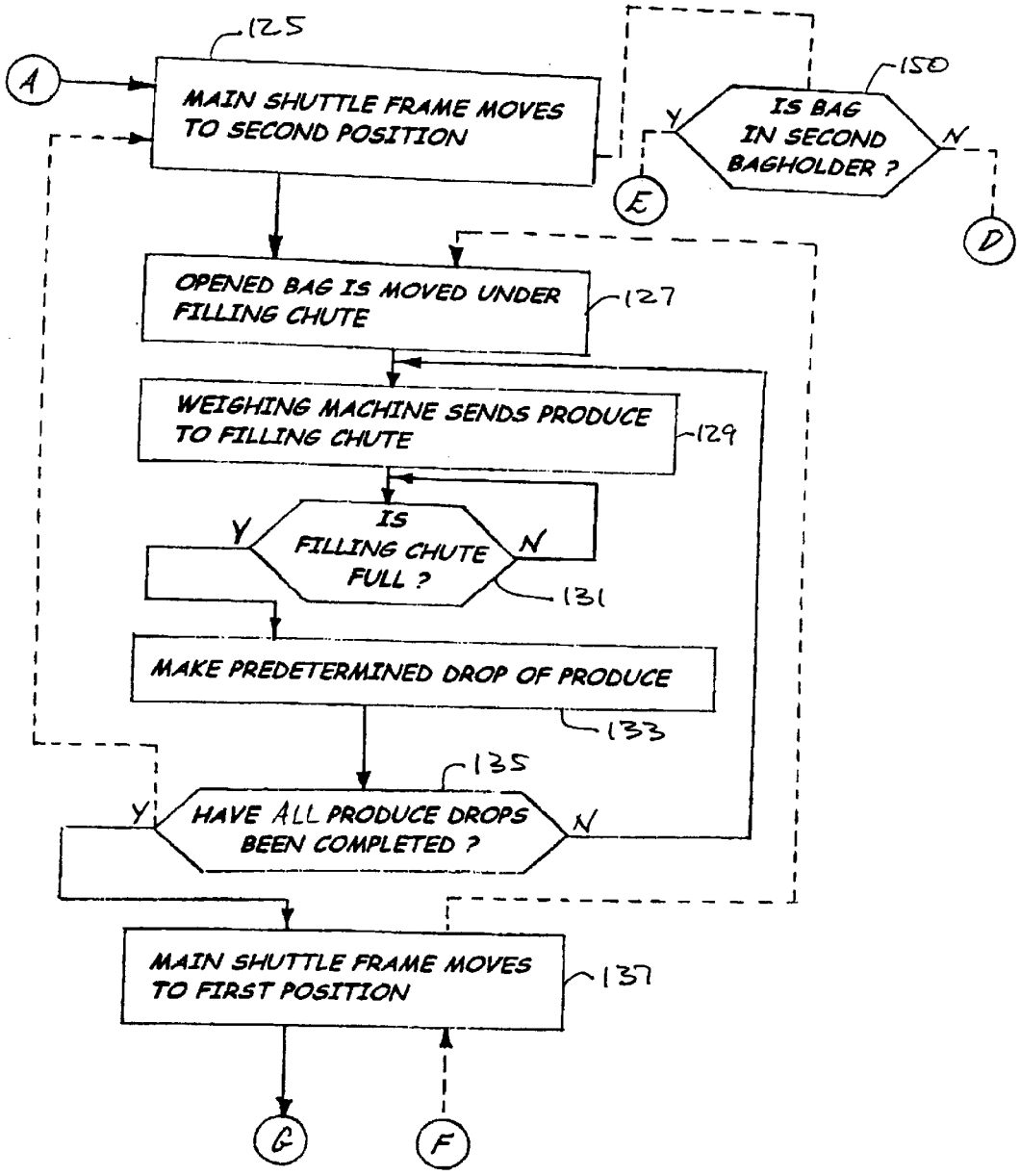

The method and general operation of the present invention are shown in the flow diagram illustrated in FIG. 8. In preparation for operation, the machine is connected to a source of air pressure to thereby operate various pneumatic actuators. Supply rolls of plastic bag material are loaded into the bag supply assemblies. The operation of the machine is then started by energizing the PLC.

From the start (Block 101), the PLC will signal the bag feeder to activate and begin feeding bags into the bag holders (Block 103). As bags are loaded, the spark generator is active and as bag perforations pass under the spark generator a spark will cross through the perforations to the spark detector, thereby sending bag sensing information to the controller. The controller keeps time responsive to the sensor signal and stops the bag feed assembly when a bag is properly positioned in the bag holder (Block 105). The bag feeder will continue feeding bag material until, responsive to the sensing information, the controller determines that a bag is in position (Block 107). Once the bag is placed within the bag holder, the second side member moves toward the first side member and thereby clamps the bag therebetween (Block 109), and the vacuum is turned on (Block 111). As the second side member clamps the bag, the knife which is adjacent the second side member cuts through the line of perforations and separates the individual bag from the continuous stream of bag material (Block 113). At the same time, the bag feed drive roller reverses to withdraw the continuous sleeve of bag material from the bag holder (Block 119), leaving the separated individual bag clamped within. The suction plates are activated to apply vacuum to the upper edges of the individual bag, and as they apply suction, the suction plates also are raised to contact clamping plates and thereby clamp the upper edges of the open bag between the suction plates and the clamping plates (Block 115). Two bag guides move to a mid position to align with the sides of the open bag in preparation for the bag receiving produce fill (Block 117), and in cooperation with the suction plates, the bag holder is actuated (Block 121) to hold open the bag (Block 123).

The shuttle assembly then moves the loaded open bag (Block 125) so that the bag aligns with the filling station (Block 127). When the bag is properly aligned with the filling station, the controller sends a signal to the weighing machine for delivering produce to the chute (Block 129). As described, a produce weighing machine is preferably positioned in combination with the present bagging machine to deliver pre-weighed quantities of produce into the filling station, as illustrated in FIG. 1. In this combination, the controller is additionally operatively connected to control the weighing machine. When the filling chute is full (Block 131), a drop of produce is made into the bag (Block 133). Once the filling chute has made a drop, it moves upwardly in the filling station mast to receive another quantity of produce. The filling chute cycle will repeat until the bag is filled with predetermined amount of produce (Block 135). Generally, it takes about ten drops of the filling chute to deliver approximately fifty pounds of carrots into a bag. When a bag is filled, the shuttle will move the filled bag back to its bag loading station (Block 137) and reciprocatingly position a second bag in line with the filling station.

While the filling chute is delivering produce to the first bag, the second bag holder is positioned at the second bag loading station. The controller determines if there is a bag positioned in the second bag holder (Block 150). If there is no bag, the second bag holder loaded with a second bag (Block 154). Bag feeding continues until a bag is positioned in the second bag holder (Block 156). As described for the first bag, above, the operation continues for preparing the second bag for filling. Once the second bag is placed within the second bag holder, the second side member moves toward the first side member and thereby clamps the bag therebetween (Block 158). The vacuum is then turned on (Block 160). As the second side member clamps the bag, the knife which is adjacent the second side member cuts through the line of perforations and separates the individual bag from the continuous bag material (Block 162). At the same time, the bag feed drive roller reverses to withdraw the continuous sleeve of bag material from the bag holder (Block 168), leaving the separated individual bag clamped within. The suction plates are activated to apply suction to the upper edges of the individual bag, and as they apply suction, the suction plates also are raised to contact clamping plates and thereby clamp the upper edges of the open bag between the suction plates and the clamping plates (Block 164). Two bag guides move to a mid position to align with the sides of the open bag in preparation for the bag receiving produce fill (Block 166), and in cooperation with the suction plates, the bag holder is actuated (Block 170) to hold open the bag (Block 172).

As the shuttle moves the filled first bag to the first bag loading station for unloading (Block 137), it also simultaneously moves the second bag under the filling chute for filling (Block 127). While the second bag is being filled, an operator opens an access door (Block 139), manually removes the filled first bag from the bag loading station (Block 141), and depresses a foot pedal (Block 142) to thereby close the access door (Block 143). Once the operator unloads the filled bag and closes the access door, the operator preferably controls the cycling of the machine by depressing a foot pedal connected to signal a start (Block 101) and a new bag is loaded into position in the first bag holder (Block 103), thus starting the machine cycle once again.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A produce bagging machine comprising:

a movable shuttle frame;

a bag holder supported by the shuttle frame, the bag holder comprising:

a first side member fixedly connected to the shuttle, the first side member defining a first periphery of the bag holder;

a second side member movably connected to the shuttle substantially opposite the first side member, the second side member defining a second periphery of the bag holder, a movement of the second side member creating a void space between the first and the second side member;

means for feeding a bag between the first and the second side members;

a suction plate positioned for contacting upper peripheries of opposite sides of a fed bag connectable to suction means for applying sufficient suction to pull the upper peripheries apart to form an open bag; and a clamping plate connected to each side member operable to clamp the upper peripheries of the open bag to secure the bag in an open position preparatory to being filled;

a filling chute positioned to deliver produce into the bag; and a controller for controlling a movement of the shuttle frame between a first position adjacent the bag feeding means for positioning a bag in the bag holder and a second position adjacent the filling chute for receiving produce into the bag, the controller further for controlling the bag feeding means.

2. The machine of claim 1, wherein the filling chute is movable to a first position for receiving produce from a produce supply and to a second position for orientedly placing the received produce within the bag.

3. The machine of claim 1, wherein the filling chute fills the bag by movably entering the bag for successively orientedly placing produce therein.

4. The machine of claim 1, wherein the filling chute is substantially box shaped having an upper end and a lower end, a first opening positioned at the upper end for receiving produce, an interior cavity for therein holding the produce, and a second opening positioned at the lower end for therethrough delivering the produce.

5. The machine of claim 1, further comprising at least one bag supply which includes a bag supply reel positioned to hold a supply of bags in the form of a roll of continuous bag material.

6. The machine of claim 1, wherein said at least one bag supply further includes a bag feeder positioned for feeding bags into a bag holder.

7. The machine of claim 1, wherein said at least one bag supply further includes a bag feed drive roller positioned for feeding a continuous stream of bag material into a bag holder.

8. The machine of claim 7, further including a bag feed tensioner positioned for maintaining tension in the continuous stream of bag material to thereby substantially prevent the formation of slack in said continuous stream.

9. The machine of claim 1, wherein said at least one bag supply further includes a bag sensor positioned for providing bag sensing information for positioning a bag in an individual bag holder of the plurality of bag holders.

10. The machine of claim 1, wherein said at least one bag supply comprises a roll of continuous bag material having a plurality of preformed bags, wherein each individual bag of the plurality is demarcated from an adjoining bag by a line of perforations extending across a width of said continuous bag material to thereby make each individual bag separable from the continuous bag material.

11. The machine of claim 10, further comprising a sensor positioned adjacent a direction of manufacture for sensing when a bag is positioned in a bag holder.

12. The machine of claim 1, further comprising a support frame to which the shuttle is movably connected for moving each bag holder of the plurality such that a bag positioned therein is substantially aligned with said filling chute.

13. The machine of claim 1, further comprising a filling tower housing a movable filling chute, the chute being movable upwardly to an upper end of the tower for receiving produce and downwardly into a bag held in a bag holder to thereby place produce into the bag.

14. The machine of claim 1, wherein said machine comprises two bag holders connected to substantially opposite ends of a the shuttle, and wherein the filling chute is about equidistant from said opposite ends.

15. The machine of claims 1, further including at least one bag unloading station having an access door for an operator to therethrough unload a produce filled bag from the machine.

16. The machine of claim 1, wherein said machine comprises a produce supply and weighing machine connected to deliver quantities of produce to said filling chute for filling the bags.

17. A produce bagging machine comprising:

at least one bag supply positioned to hold a supply of bags;

a reciprocating shuttle comprising a plurality of bag holders connected for positioning a bag from the supply of bags for filling, each bag holder comprising:

a) a first side member fixedly connected to said shuttle so as to define a first periphery of the bag holder;

b) a second side member movably connected to said shuttle spaced-apart and substantially opposite from the fixed side member so as to define a void space therebetween of sufficient size for holding a bag having a capacity of up to about fifty pounds of produce;

c) a knife blade positioned for separating an individual bag from said supply of bags for positioning in the bag holder;

d) a suction plate connected to each of said first and second side members for contacting upper peripheries of a bag positioned in the bag holder for applying suction thereto for pulling said peripheries apart forming an open bag;

e) a clamping plate connected to each said side member so as to clamp upper peripheries of the open bag to thereby secure the open bag in a position ready for filling with produce; and f) a bag guide movably connected relative to said side members so as to adjacently align with exterior sides of the open bag to thereby guide produce for filling the bag evenly; and a filling chute positioned for receiving produce from a produce supply and for delivering the produce into the bag.

* * * * *